US005308007A

United States Patent [19]

Stroszynski

[11] Patent Number: 5,308,007

[45] Date of Patent: May 3, 1994

[54] BAND-CHANGING APPARATUS FOR A FLYING BAND CHANGE

[75] Inventor: Joachim Stroszynski, Wiesbaden, Fed. Rep. of Germany

[73] Assignee: Hoechst Aktiengesellschaft, Frankfurt am Main, Fed. Rep. of Germany

[21] Appl. No.: 981,918

[22] Filed: Nov. 23, 1992

Related U.S. Application Data

[63] Continuation of Ser. No. 610,010, Nov. 7, 1990, abandoned.

[30] Foreign Application Priority Data

Nov. 9, 1989 [DE] Fed. Rep. of Germany ..... 3937286

[51] Int. Cl.[5] ..... B65H 57/00; B65H 19/00; B65H 19/16

[52] U.S. Cl. ..... 242/58.1; 15/306.1; 83/384; 156/504; 242/58.4

[58] Field of Search ..... 242/58.1, 58.3, 58.4, 242/58.5; 156/504, 510, 511; 15/306; 83/343-345; 53/389.1-389.4; 226/109, 110

[56] References Cited

U.S. PATENT DOCUMENTS

| | | | |
|---|---|---|---|
| 3,072,354 | 1/1963 | Giles et al. | 242/58.4 |
| 3,398,911 | 8/1968 | Poupin | 242/58.4 |
| 3,460,549 | 8/1969 | Webb | 134/64 |
| 3,467,541 | 9/1969 | Aronnson et al. | 15/306.1 X |
| 3,580,757 | 6/1971 | Niepmann | 242/58.4 |
| 3,873,393 | 3/1975 | Bruck et al. | 242/58.1 X |
| 3,886,031 | 5/1975 | Taitel | 242/58.4 |
| 4,010,911 | 3/1977 | Heitmann | 242/58.4 |
| 4,017,982 | 4/1977 | Goffredo | 15/306.1 X |
| 4,065,067 | 12/1977 | Martinez | 242/58.1 |
| 4,106,974 | 8/1978 | Hirsch | 156/504 |
| 4,190,475 | 2/1980 | Marschke | 242/58.4 X |
| 4,363,695 | 12/1982 | Marass | 242/58.4 X |
| 4,415,127 | 11/1983 | Seragnoli | 242/58.1 |
| 4,420,999 | 12/1983 | Hirakawa et al. | 83/343 X |
| 4,541,221 | 9/1985 | Seragnoli | 242/58.1 X |
| 4,548,112 | 10/1985 | Thomas | 83/343 X |
| 4,645,554 | 2/1987 | Wyser | 242/58.3 X |
| 4,700,642 | 10/1987 | Hankinson, Jr. | 242/58.4 X |
| 4,720,320 | 1/1988 | Niemi | 156/504 |

FOREIGN PATENT DOCUMENTS

| | | | |
|---|---|---|---|
| 0182724 | 5/1986 | European Pat. Off. . | |
| 1123898 | 2/1962 | Fed. Rep. of Germany . | |
| 1261366 | 2/1968 | Fed. Rep. of Germany . | |
| 62-021523 | 1/1987 | Japan | 156/504 |
| 1316062 | 5/1973 | United Kingdom . | |
| 1475594 | 6/1977 | United Kingdom . | |

*Primary Examiner*—Daniel P. Stodola
*Assistant Examiner*—John Rollins
*Attorney, Agent, or Firm*—Foley & Lardner

[57] ABSTRACT

A band-changing apparatus for flying band change which consists of two unwinding stations which are arranged adjacent to a band changer. From the respective unwinding stations, a new band and a running-off band are brought together in the band changer in a V-shaped manner from the top downwards through two channels and enter into a pressure-roller unit rotary stops are provided in the channels for controlling movement of the respective bands. The band changer also possesses two rotary crosscutters for cutting the bands to size. The new band is equipped with an adhesive strip which leads to an adhesive bond with the running-off band in the pressure-roller unit.

21 Claims, 2 Drawing Sheets

BAND-CHANGING APPARATUS FOR A FLYING BAND CHANGE

This application is a continuation of application Ser. No. 07/610,010, filed Nov. 7, 1990, now abandoned.

BACKGROUND OF THE INVENTION

The invention relates to a band-changing apparatus for a flying band change from a running-off band to a new band, each of which runs through a plurality of processing stations in an in-line band installation, with an unwinding station for each running-off band and for each new band.

In in-line working band installations, in which, for example, aluminum bands are pickled, roughened, anodized, coated and made up, the band running off from one band roll has to be connected to the following band of a new band roll, without the treatment of the band in the subsequent installations being interrupted. For this, band stores of high capacity are conventionally set up between the unwinding stations and the treatment installations.

In a known multi-star turning unwinding station, the band change begins with the severing of the old band, for which a rolling knife running transversely underneath the old band is used. In synchronization with the running-away band end, the new band is pressed against the running-off band by a press-contact roller, so that a firm adhesive bond between the band start of the new band roll and the old band is obtained, the band start of the new band previously being covered with a double-sided adhesive tape. In this band change, the severing knife works by flying and transversely cutting relative to the band running direction. The cutting quality and band connection thereby obtained are not ideal. The band-changing apparatus is also largely unsuitable for full automation and great attentiveness and much skill are required of the personnel during the band change. The production stoppages and material losses occurring when a band-change has been made incorrectly are high, and with an increase in working speed this known band changing system becomes more and more difficult to operate.

SUMMARY OF THE INVENTION

The object of the invention is to improve a band-changing apparatus and a process of the type described in the introduction, in such a way that it ensures a simple operation, even at band running speeds of 50 m/min and higher and achieves an excellent adhesive bond between the running-off band and the new band, with a short free overlap of, for example, no more than 250 mm at the end of the adhesive bond, at a low outlay in terms of construction and with a small amount of space required for the band-changing apparatus.

According to one aspect of the present invention, there has been provided a band-changing apparatus for instituting a flying band change from a running-off band to a new band in an in-line band installation, comprising at least a first and second unwinding station separately positioned from one another, each of the unwinding stations having a band roll rotatably disposed therein, a first band roll serving to hold the new band thereon and a second band roll serving to hold the running-off band thereon; a band changer having a first end and a second end; feeding means, for feeding the new band and the running-off band from the band rolls into the band changer; a pressure roller unit rotatably disposed in the second end of the band changer; and V-shaped channeling means for channeling the new band and the running-off band from the first end of the band changer downwardly through to the second end of the band changer such that the new band and the running-off band converge in the pressure roller unit.

In accordance with another aspect of the present invention, there has been provided a method for changing a running-off band to a new band in an in-line band installation, with a band changer and separately positioned unwinding stations provided for the running-off band and the unwinding band, the method comprising the steps of 1) feeding the new band and the running-off band from band rolls of the unwinding stations to the band changer, 2) bringing the new band and the running-off band together in a V-shaped manner downwardly through the band changer and into a pressure-roller unit, and 3) bonding the running-off band to the new band in the pressure-roller unit.

The band-changing apparatus according to the invention affords the advantages that the flying band change between the running-off band and the new band is obtained with only a small overlap of approximately 250 mm of the splice, that the adhesive bond is pressed down smoothly and is firm, that the end portion of the running-off band is cut off cleanly and at right angles, and that the flying band change can be controlled and executed reliably by a one-man operation of the band-changing apparatus.

Further objects, features and advantages of the invention will become apparent from the detailed description of exemplary embodiments which follows, when considered together with the drawings.

DETAILED DESCRIPTION OF THE PREFERRED EMBODIMENTS

The band-changing apparatus of the present invention comprises, next to the unwinding stations, a band changer as a central part, the unwinding stations are set up separately from one another, and the new band and the running-off band are fed from band rolls in the unwinding stations to the band changer and are brought together in this in a V-shaped manner from the top downwards in a pressure-roller unit, in which the running-off band and the new band can be joined together.

In the band-changing apparatus according to the invention, the running-off band and the new band are guided separately as far as the pressure-roller unit. The end portion of the running-off band is severed from the running-off band in front of the pressure-roller unit by means of rotary crosscutters, and the adhesive bond of the running-off band with a dry adhesive film previously affixed to the new band is made in the pressure-roller unit.

Figure 1:
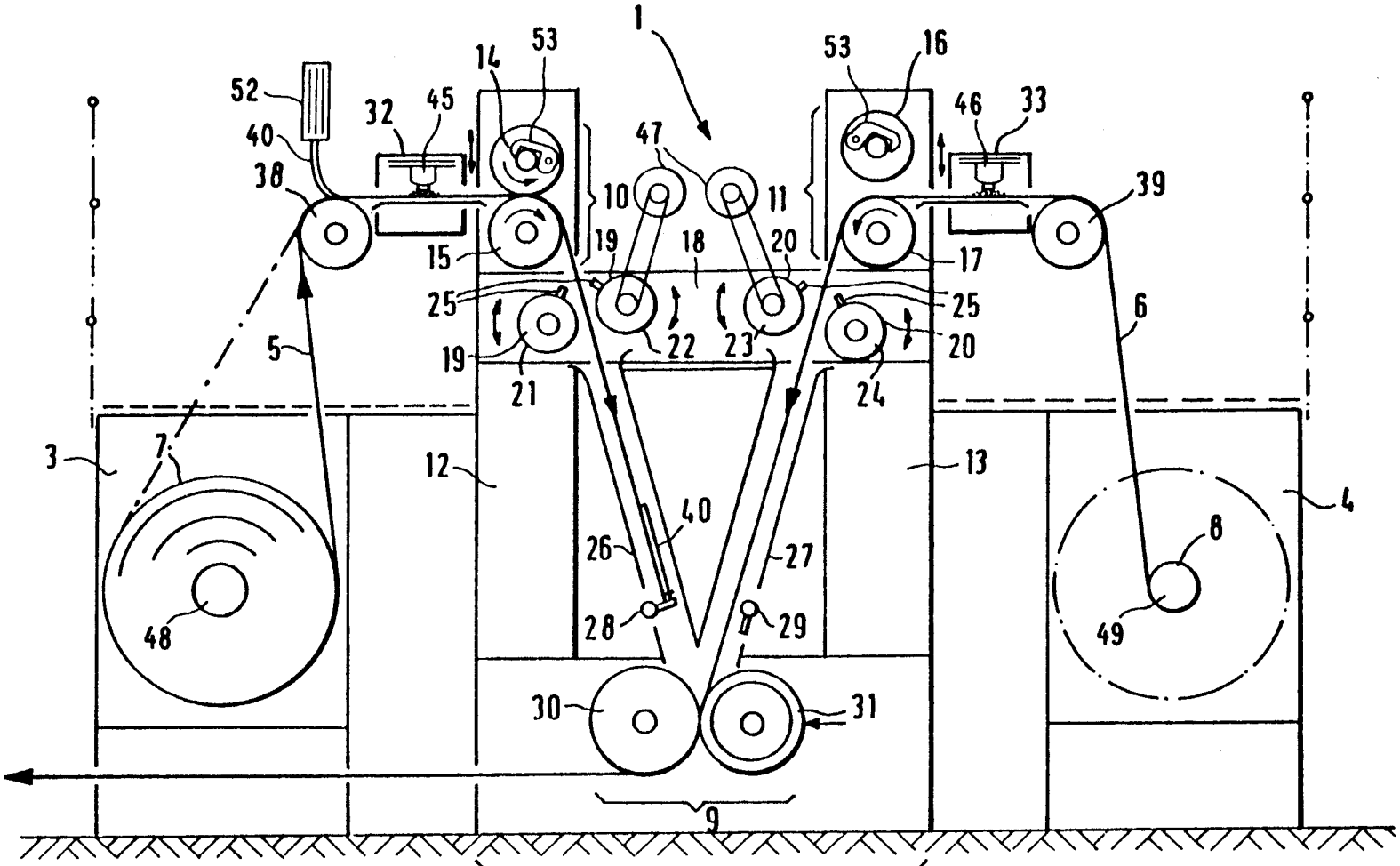
FIG. 1 shows a diagrammatic view of a first embodiment of a band-changing apparatus with two unwinding stations and with a central band changer.

More specifically, a band-changing apparatus 1 shown diagrammatically in FIG. 1, comprises a centrally arranged band changer 2, on the left and right side of which a respective unwinding station 3 or 4 is arranged. The band changer 2 stands vertically, and a new band 5 and a running-off band 6 are fed to the band changer 2 from band rolls 7 and 8 in the unwinding stations 3 and 4. The band rolls 7 and 8 are motor-driven, and the bands 5 and are guided upwards from the band rolls 7 and 8 around deflecting rollers 38, 39 and run horizontally through chambers 32, 33, in which the surface of the respective running-off band 5 or 6 is degreased, for example, by means of a steam cleaning device 45 or a compressed air cleaning device 46. In FIG. 1, the band 5 runs off from the band roll 7 in the counterclockwise direction, but it can just as well run off in the clockwise direction, as represented by a dot-and-dash line in FIG. 1.

The band changer 2 comprises two stands 12 and 13 integrally formed in opposite side walls of the band changer, in the upper portion of each of which there is a press-contact roller unit 10 or 11 which consists of a press-contact roller 14 or 16 and a counterpress-contact roller 15 or 17. Arranged in pairs on a cross-member 18 of the band changer 2 are crosscutters 19, 20 which are, for example, rotary crosscutters. Each of the crosscutters 19, 20 comprises two rollers 21, 22 and 23, 24. A cutting blade 25 is fastened to each of these rollers 21 to 24. The cutting blades in the case of rotary crosscutters 19, 20 form with the rollers 21, 22 and 23, 24 knife bars which, during cutting, are rotated forwards or backwards through 180° by means of pneumatically driven rotary pistons. Instead of pneumatically driven rotary pistons, it is also possible to use electrical rotary pistons or controlled electric motors forming so-called direct drives, which rotate the cutting blades through 360° for each cut, bring them additionally into synchronous circular motion, and after the cut, bring them to a stop again in the initial position. By means of the rotary crosscutters 19, 20, the particular band 5,6 is severed in the shortest possible time, virtually instantaneously. As such, the present band-changing apparatus 1 with crosscutters as severing systems for the bands, by means of which a band change is carried out, is the most suitable band changer, especially at high band speeds of more than 50 m/min. Furthermore, the bands are severed at right angles or virtually at right angles and cleanly.

The crosscutters can also be synchronous crosscutters which rotate continuously at a cutting speed equal to the band running speed. The interacting rollers of an individual crosscutter 19 or 20 are coupled to one another via gearwheels. The rotary-piston cylinders (not shown) which engage on the two ends or only on one end of each of the rollers and which drive the rollers reset the cross-cutters to their initial positions after each cut.

A further embodiment of the crosscutter consists of a stationary bar knife and of a rotary crosscutter. An embodiment composed of a stationary bar knife and of a bar knife moveable relative to this is likewise suitable.

As further illustrated in FIG. 1, the bands and 6 are guided within the band changer 2 in channels 26, 27 converging in a V-shaped manner. Rotary stops 28, 29 are located within these channels 26, 27 near the lower end of the latter and can be pivoted into the path of movement of the bands 5, 6.

The bands 5 and 6 run in the channels 26, 27 in a V-shaped manner from the top downwards and are brought together in a pressure-roller unit 9, in which the running-off band and the new band are joined together. Pressure-roller unit 9 consists of a driving roller 30 and of a pneumatically actuated pressure roller 31. The driving roller 30 works as a main braking roller, and a very high linear pressure prevails between the driving roller 30 and the pressure roller 31. The pressure roller 31 is already in the working position before the active band-changing operation commences.

To make an adhesive bond between the running-off band 6 and the new band 5, a double-sided adhesive strip is affixed to the leading end of the new band 5. With the press-contact roller 14 being lifted off, from the counter press roller 15 in the press-contact roller unit 10 the leading end of the web thus prepared can be moved or pushed forwards in the channel 26 until it comes to bear on the rotary stop 28 pivoted into the path of movement.

The press-contact rollers 14 and 16 of the press-contact roller units 10, 11 are each equipped with a return stop 53 and have an overriding clutch on the driving side. The press-contact rollers 14, 16 are lowered as required. For example, at the initiation of a band change the press-contact roller 14 only is lowered and subsequently driven. At the same moment, the band roll 7 can be accelerated. As soon as the bands 5, 6 are joined together in the pressure-roller unit 9, the new band 5 runs at the same working speed as the running-off band 6 which has previously been severed. During the phase of accelerating the bands, the rotational speed of the press-contact rollers 14 and 16 is synchronized with the band speed. After the band change has taken place, the press-contact rollers 14, 16 are lifted off from the counter press rollers 15 and 17.

As is evident from FIG. 1, the rotary stop 29 in the channel 27 is pivoted out of the path of movement of the running-off band 6 which is guided through between the driving roller 30 and the pressure roller 31. The leading edge of the new band 5 bears against the rotary stop 28 located in the channel 26 and pivoted into the path of movement. The adhesive strip 40 fixed to the initial portion of the new band 5 is shown enlarged in FIG. 1 and terminates approximately 1 to 2 cm upstream of the leading edge of the band 5. In this holding position of the new band 5, the press-contact roller 14 is pressed against the counter press roller 15 of the press-contact roller unit 10. At a particular moment, the band 6 running off from the band roll 8 is severed or cut through. At the same time, the rotary stop 28 is pivoted out of the path of movement in the channel 26, and the start of the band 5 with the adhesive strip 40 is moved forwards into the pressure zone of the pressure-roller unit 9 by the driven press-contact roller 14. The leading end of the new band 5 is pressed onto the running-off band 6 in the nip between the driving roller 30 and the pressure roller 31. The band 5 is introduced between the driving or main braking roller 30 and the pressure roller 31, where there prevails a very high linear pressure which makes a firm adhesive bond between the adhesive strip 40 of the new band 5 and the running-off band 6. The severing cut on the running-off band 6 takes place synchronously with the band speed of the running-off band 6 and with the run-in speed of the new band 5, in such a way that the running-off band 6 covers the adhesive strip 40 completely and shortly thereafter terminates with a free overlap of the adhesive strip, the overlap being of the order of 100 to 250 mm. Since the cut is made by the rotary crosscutter 20 transversely relative to the band 6 and at right angles or virtually at right angles, a very clean non-jagged adhesive bond between the new band 5 and the running-off band 6 is obtained.

The band-changing apparatus 1 illustrated in FIG. 1 is especially suitable for high and very high band speeds in the range of 50 m/min and above.

The illustrated arrangement of the unwinding stations 3 and 4 symmetrical in relation to the band changer 2 is highly advantageous in terms of the band guidance and the operation of the band-changing apparatus 1 on the spot. The unwinding stations 3 and 4 are equipped, for example, with a clamping mandrel 48 and 49, respectively, which has a free end and receives the particular band roll 7 or 8 which can be pushed onto the clamping mandrel 48, 49 by means of a special lifting carriage. A work platform (not shown) is conventionally located above the band rolls 7 and 8. Between the deflecting roller 38 and the press-contact roller unit 10 in the region of the new band 5 there is a work table (not shown), where an adhesive strip 40 can be applied to the initial portion of the new band 5 by hand or automatically by an adhesive-strip dispenser 52. Instead of an adhesive strip, an adhesive layer can also be applied to the leading end of the new band 5 manually or by means of an adhesive dispenser. The bands 5 and 6 are, above all, aluminum webs which form the basis for producing printing plates, but the band-changing apparatus is also suitable for bands made of other metals, plastic, paper or such like materials. After the prepared leading end of the band has been introduced into the band-changing apparatus 1 until the leading edge bears on the rotary stop 28, the band change can be triggered at any desired moment, as described above.

Figure 2:
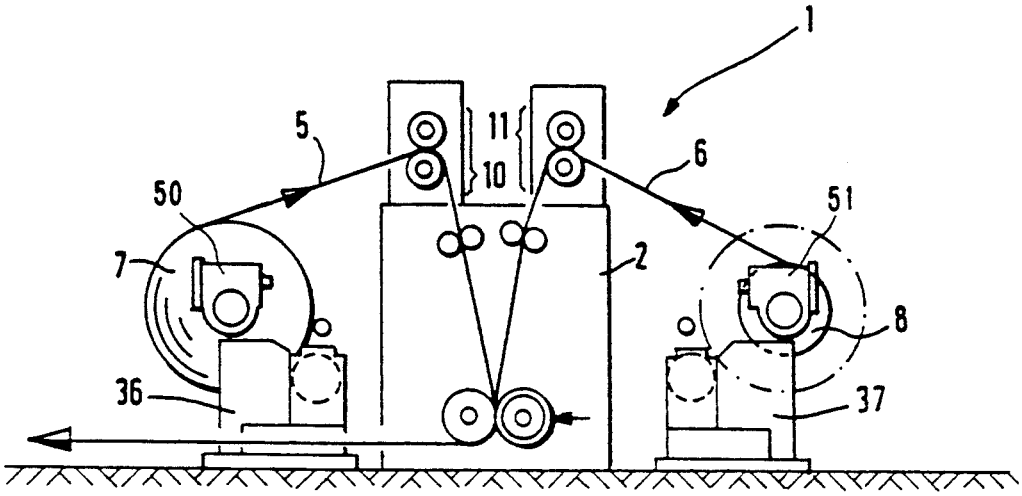
FIG. 2 shows a diagrammatic view of a second embodiment of the band-changing apparatus, similar to that of FIG. 1, with an unwinding of the band rolls which is modified in relation to the first embodiment.

FIG. 2 shows diagrammatically a band-changing apparatus 1 constructed in a similar way to the embodiment according to FIG. 1, and consisting of a band changer 2 and of unwinding stations 36 and 37 which are arranged symmetrically to this on the left and right of it and which are standard unwinding stations with the band rolls suspended on both sides by feeding means 50, 51. This means that, in contrast to the embodiment according to FIG. 1, the clamping-mandrel unwinding stations are not used. The remaining components of this embodiment of the band-changing apparatus 1 correspond substantially to the embodiment according to FIG. 1, and therefore they are not described again.

Figure 3:
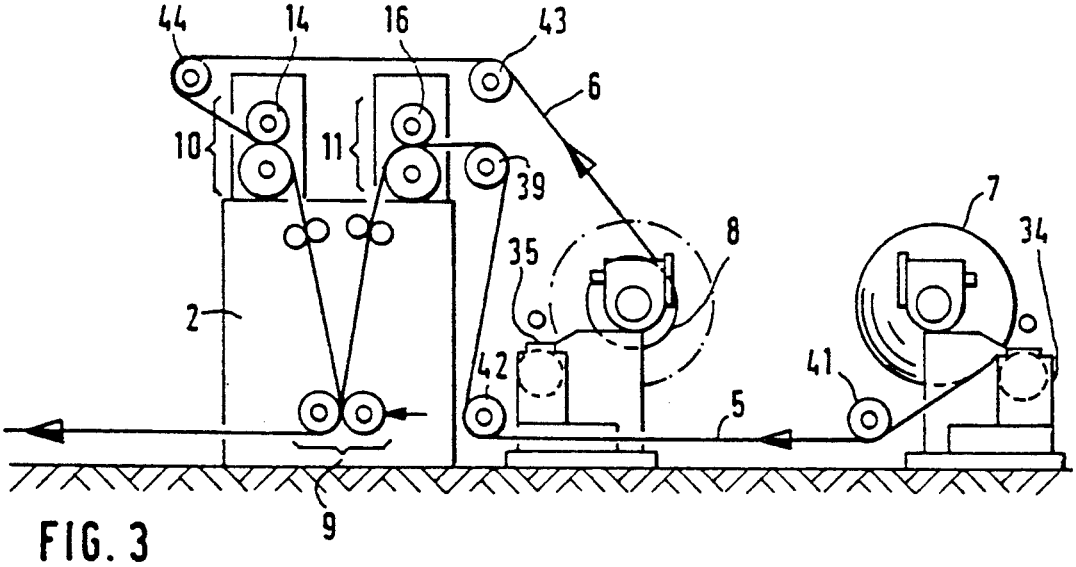
FIG. 3 shows a diagrammatic view of a third embodiment of the band-changing apparatus, in which the unwinding stations are arranged on one side of the band changer.

FIG. 3 shows diagrammatically a further embodiment of the band-changing apparatus in which the two unwinding stations 34 and 35 are arranged on one side of the band changer 2. This means that the two unwinding stations 34, 35 which are equipped, for example, with clamping mandrels are located on one side of the band changer and flank this non-symmetrically. The unwinding station 35 with the running-off band 6 is arranged nearest to the band changer 2. The band 6 drawn off from the band roll of the unwinding station 35 is guided obliquely upwards via two deflecting rollers 43 and 44 and after the deflecting roller 44 passes into the press-contact roller unit 10 and from this through between the rotary crosscutter 19 into the pressure-roller unit 9. The unwinding station 34 for the new band 5 is arranged further away from the band changer 2. The new band 5 to be unwound is guided obliquely downwards and transported further horizontally via deflecting rollers 41 and 42. After the deflecting roller 42. the band 5 is guided upwards and, via the deflecting roller 39, horizontally into the press-contact roller unit 11 and after this is steered through between the rotary crosscutter 20 downwards into the pressure-roller unit 9, in which the new band 5 and the running-off band 6 are joined together in the same way as described with reference to the embodiment according to FIG. 1.

The testing of the band-changing apparatus 1, as shown in FIG. 3, was conducted by way of example under the following conditions:

Band speed v=20 m/min
Band width of the two bands 5 and 6: 1100 mm
Band thickness: 0.28 mm and
Band speed v=55 m/min
Band width of the bands 5 and 6: 905 mm
Band thickness: 0.28 mm. 30 The moment for severing the running-off band 6 in relation to the moment for switching-on the drive of the upper press-contact roller 14 of the press-contact roller unit 10 for the new band 5, that is to say the band to be unwound, was advanced by approximately 3 seconds. The band change took place in exact time synchronism, and the band end of the running-off band 6 cut off at right angles covered the splice by approximately 250 mm at the band speed v=20 m/min and by approximately 100 mm at the band speed v=55 m/min, in the latter case the moment for switching-on the drive of the upper press-contact roller 14 of the press-contact roller unit 10 being advanced by approximately 1.4 seconds in relation to the cutting off of the running-off band 6. In both cases, the adhesive bonds were pressed down smoothly and were firm and had a length of up to 600 mm.

The operating functions of the band-changing apparatus 1 are appropriately combined for one-man operation in a key board, so that the band change can be triggered from one place.

In each of the foregoing drawings of FIGS. 1 to 3, the original diameter of the band roll of the running-off band 6 is represented by dot-and-dash lines.

What is claimed is:

1. A band-changing apparatus for instituting a flying band change from a running-off band to a new band in an in-line band installation comprising:

at least a first and a second unwinding station separately positioned from one another, each of said unwinding stations having a band roll rotatably disposed therein, a first band roll serving to hold the new band thereon and a second band roll serving to hold the running-off band thereon;

a band changer having a first end and a second end;

feeding means for feeding the new band and the running-off band from said band rolls into the band changer, said feeding means including press-contact roller units;

means for applying an adhesive layer to the new hand;

means for applying an adhesive layer to the new band;

channeling means, which converge in a V-shaped configuration, for channeling said new band and said running-off band from the first end of the band changer downwardly through the second end of the band changer such that said new band and said running-off band converge in said pressure roller unit;

wherein said channeling means comprises two channels which are positioned in a central portion of said band changer and converge in said V-shaped configuration such that said new band and said running-off band are guided through the press-contact roller units and the channeling means and into the pressure roller unit;

wherein the new band and the running-off band adhere to each other in the pressure roller unit; and wherein centers of said band rolls are positioned at a level near lower ends of said channels; and a pair of rotary stops, each of which is located within one of said two channels near the lower end of the channel, each of said rotary stops being pivotable into and out of the path of movement of one of the new band and the running-off band.

2. The band-changing apparatus as claimed in claim 1, wherein said unwinding stations are symmetrically positioned on either side of the band changer.

3. The band-changing apparatus as claimed in claim 1, wherein said band changer comprises opposed side walls; and wherein said feeding means comprises two stands integrally formed in said opposed side walls of said band changer; and two said press-contact units rotatably positioned in an upper portion of each stand for rotatably receiving said new band and said running-off band, even press-contact unit comprising an upper driven press-contact roller and a lower counterpress roller between which the new band and the running-off band are guided.

4. The band changing apparatus as claimed in claim 3, wherein each of said press-contact rollers is equipped with a return stop.

5. The band-changing apparatus as claimed in claim 3, wherein said feeding means further comprises at least two cleaning chambers positioned on opposite sides of the band changer and symmetrical to the press-contact roller units, such that said new band and running-off band are run through the chambers to clean the surfaces of the bands.

6. The band-changing apparatus as claimed in claim 5, wherein said cleaning chambers include a steam cleaning device.

7. The band-changing apparatus as claimed in claim 5, wherein said cleaning chambers include a compressed air cleaning device.

8. The band-changing apparatus as claimed in claim 1, further comprising:

a cross member connecting said opposite side walls of said band changer, and at least two crosscutters for severing the new band the run-off band, rotatably positioned on said cross member at opposite ends of said cross member.

9. The band-changing apparatus as claimed in claim 8, wherein said crosscutters are of the rotary type, with each crosscutter comprising two driven rollers rotatable through 180 degrees, each roller having a cutting blade, such that the new band is guided through and between the rollers of one crosscutter and the running-off band is guided through and between the rollers of the other crosscutter.

10. The band-changing apparatus as claimed in claim 6, wherein said rollers of an individual crosscutter are coupled to one another, and wherein rotary-piston cylinders drive the rollers of the crosscutters from an initial position to a cutting position during the severing and, after the severing, reset the cutters back to their initial position.

11. The band-changing apparatus as claimed in claim 8, wherein the crosscutters are rotary crosscutters, each of which rotates at a cutting speed equal to a band running speed.

12. The band-changing apparatus as claimed in claim 8, wherein each crosscutter comprises a rotary crosscutter including two rollers.

13. The band changing apparatus as claimed in claim 9, further comprising a plurality of cutting blades, one of said blades being connected to each roller, and wherein each cutting blade cooperates with a blade on an associated roller to form a knife bar.

14. The band-changing apparatus as claimed in claim 1, wherein said pressure-roller unit comprises a driving roller and a pressure roller which is pneumatically pressed against the driving roller, with said new band and running-off band being guided between the driving roller and pressure roller by said channeling means such that the running-off band is brought into pressure contact with said new band.

15. The band-changing apparatus as claimed in claim 1, wherein the new band and the running-off band are metal bands and wherein said means for applying an adhesive layer to the new band over the band width spends a strip of a length up to 600 mm and at a distance of 1–2 cm from the leading end of the new band, said adhesive being placed on a side of the new band which is brought into pressure contact with the running-off band in the pressure-roller unit;

16. The band-changing apparatus as claimed in claim 15, wherein said new band and running-off band are aluminum.

17. The band-changing apparatus as claimed in claim 1, wherein the two unwinding stations are arranged on one side of the band changer and upstream of the band changer in a direction in which the bands are running through the band changer.

18. The band-changing apparatus as claimed in claim 1, wherein each of the unwinding stations is equipped as a mandrel unwinding station with a clamping mandrel which has a free end onto which the band roll is pushed.

19. The band-changing apparatus as claimed in claim 1, wherein the band rolls are suspended on both sides in the unwinding stations by further feeding means.

20. The band-changing apparatus as claimed in claim 1, wherein the new band and the running-off band are plastic bands and wherein said means for applying an adhesive layer to the new band over the band width spends a strip of a length up to 600 mm and at a distance of 1–2 cm from the leading end of the new band, said adhesive being placed on a side of the new band which is brought into pressure contact with the running-off band in the pressure-roller unit.

21. The band-changing apparatus as claimed in claim 1, wherein an imaginary straight line connecting the centers of said band rolls intersects at least one of said channels.

* * * * *

UNITED STATES PATENT AND TRADEMARK OFFICE

CERTIFICATE OF CORRECTION

PATENT NO. : 5,308,007

DATED : May 3, 1994

INVENTOR(S) : Joachim STROSZYNSKI

It is certified that error appears in the above-indentified patent and that said Letters Patent is hereby corrected as shown below:

Claim 1, column 6, lines 55-56, "means for applying an adhesive layer to the new hand;" should be deleted.

Claim 1, column 6, between lines 58 and 59, insert --a pressure roller unit rotatably disposed in said second end of said band changer;--.

Claim 3, column 7, line 25, delete "even" and insert --each--.

Claim 8, column 7, line 50, after "band" (first occurrence) insert --and--.

Signed and Sealed this

Twenty-third Day of August, 1994

*Attest:*

*Attesting Officer*

BRUCE LEHMAN

*Commissioner of Patents and Trademarks*